United States Patent [19]

Schultz

[11] 3,995,855

[45] Dec. 7, 1976

[54] TOY BALL

[76] Inventor: Arthur James Schultz, 5802 Forest Isle Drive, Apt. 586, New Orleans, La. 70114

[22] Filed: Nov. 18, 1974

[21] Appl. No.: 524,460

[52] U.S. Cl. ..... 273/58 F; 46/211

[51] Int. Cl.[2] ..... A63B 37/10; A63B 39/00; A63B 43/04

[58] Field of Search ..... 273/58 F, 58 C, 58 D, 273/58 E, 58 J, 95 A, 106 R, 128 A, DIG. 10; 46/211

[56] References Cited

UNITED STATES PATENTS

| | | | |
|---|---|---|---|
| 2,653,817 | 9/1953 | Tebbetts | 273/95 AX |
| 3,241,834 | 3/1966 | Stingley | 273/DIG. 10 |
| 3,452,986 | 7/1969 | Behrendsen | 273/58 J |
| 3,498,613 | 3/1970 | Dreyer | 273/58 F |

*Primary Examiner*—George J. Marlo
*Attorney, Agent, or Firm*—Morton, Bernard, Brown, Roberts & Sutherland

[57] ABSTRACT

The present invention provides a toy ball which behaves in a crazy-like manner to the extent that its path of movement is erratic or unpredictable. The present toy ball comprises an outer ball constructed of light weight rubber and an inner ball constructed of a high bounce or very resilient rubber material. The greater degree of bounce of the inner ball within the outer ball causes the assembly to behave erratically.

6 Claims, 2 Drawing Figures

TOY BALL

BACKGROUND OF THE INVENTION

The instant invention relates generally to toys, and more particularly to a child's toy which is amusing due to the erratic or unpredictable behavior of the toy which comprises a toy ball which does not follow a straight path in flight.

Toy balls comprising an inner member and an outer member designed such that the inner member can move within the outer member whereby the ball's path of movement is erratic or unpredictable are old and well known in the art. For example, one U.S. patent discloses a game ball having an outer member wherein a smaller metal ball is operably positioned such that the latter can move along specific axes of the outer member to thereby erratically influence its path of movement. Another U.S. patent discloses a toy ball comprising an outer member or sphere wherein a metal ball is operably positioned and confined to movement across the diameter of the sphere. As inherent in their design, those particular devices can only produce a limited amount of erratic motion since the inner member is allowed only to move along certain fixed desired paths within the outer member. Moreover, the erratic balls of those patents are constructed of materials which are not significantly resilient so as to produce a considerable amount of unpredictable behavior, such as would be experienced by having the inner member totally free to move within a hollow outer member. Although another U.S. patent discloses such a design, the amusement device of that particular invention is restricted to its use in a tether ball game device.

The primary object of the present invention is to provide a highly erratic or unpredictable toy ball which exhibits an unpredictable path of movement significantly greater than such toy balls heretofore manufactured and has among its advantages and features the realization of a product which is not only exceptionally amusing to children, but additionally is quite safe even when torn apart into its elemental portions.

DESCRIPTION OF THE DRAWING(S)

The above objects, together with other features and advantages of the instant invention will be apparent to one skilled in the art in light of the details of construction and operation of the present toy ball as shown in the drawing and described in the ensuing detailed disclosure of its preferred embodiments which are particularly pointed out in the appended claims. In the drawing illustrating the preferred embodiment of the present invention, synonymous reference numerals are employed throughout in the various views to refer to identical components.

FIG. 1 in the drawing depicts an elevational view of the present toy ball showing its inner member in phantom.

FIG. 2 in the drawing depicts a sectional view taken along the line A—A of FIG. 1 showing the relationship of the outer member of the present toy ball to the inner member.

DESCRIPTION OF THE PREFERRED EMBODIMENT(S)

Figure 1:
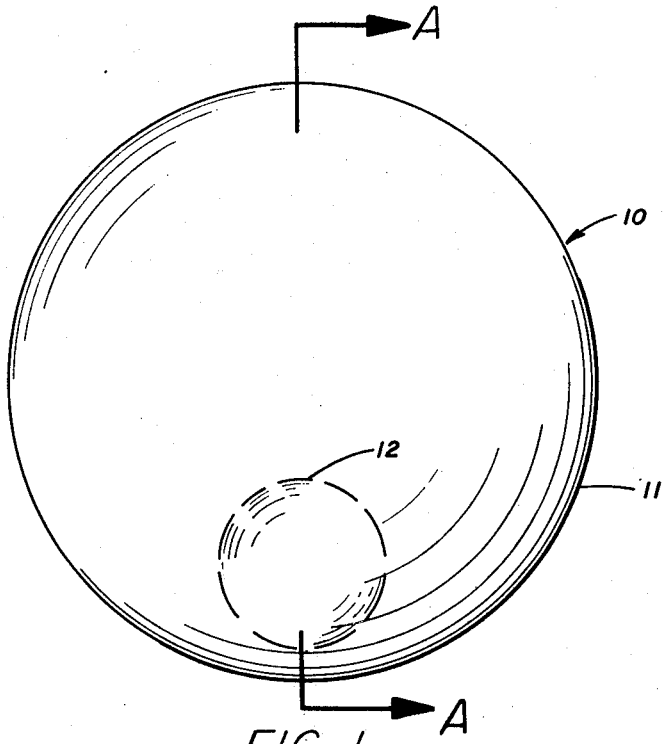
Figure 2:
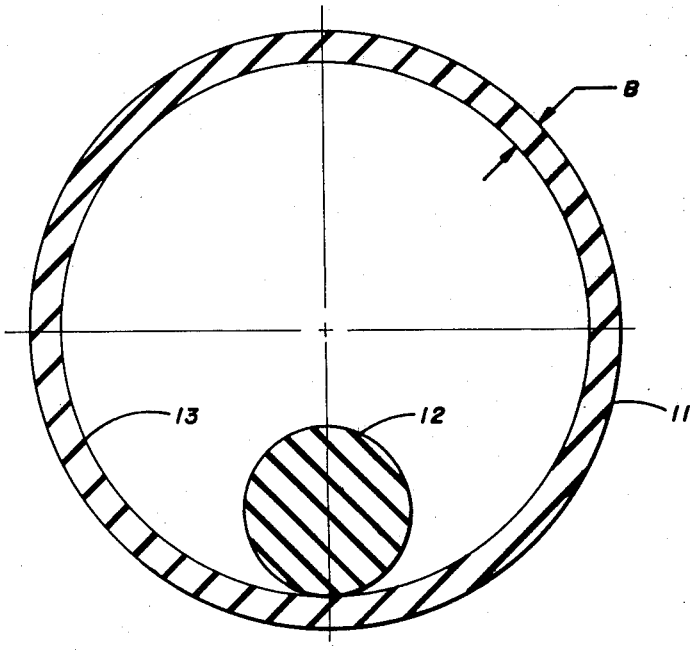

Referring to FIG. 1 of the drawing, the present toy ball 10 basically comprises the outer resilient hollow sphere 11 which is preferably a fairly resilient material, however, of less resiliency than that of the inner ball 12. The outer hollow member 11 is preferably a natural rubber, such as India rubber comprising a polyisoprene which is produced by a natural growth process in rubber trees and plants. However, a synthetic rubber of similar resiliency can be employed, such as a styrene-butadiene rubber, acrylonitrile rubber, butyl rubber, and the like. The member 11 is preferably of a diameter somewhere between 8 to 24 inches and having a wall thickness of somewhere between one to three percent of that dimension. Thus, for a 16-inch diameter ball, which is a preferred diameter, the wall thickness based upon a two percent factor would amount to approximately 5/16 inch, viz. the dimension B as shown in FIG. 2 of the drawing.

The inner ball 12 is made of a high resilient material, preferably a polybutadiene polymeric material or a masticated vulcanized cis-1,4 polyisoprene. The inner ball 12 must be of a greater resiliency that that of the outer wall in order to achieve the basic objectives of the present invention. Moreover, the inner ball material of construction should preferably have a higher coefficient of friction than that of the outer ball whereby unusual reactions by the inner ball due to its spin or English produced in the process of throwing or dropping the present toy ball is thereby greatly accentuated resulting in very unusual and erratic reactions which in turn is imparted to the outer ball thereby accentuating its path of movement and making it even more unpredictable than theretofore prior art designed toy balls. Thus, the toy ball of the instant invention achieves a much greater degree of erratic and unpredictable behavior by virtue of the unique combination of a higher resiliency material within a lower resiliency material.

The inner ball is preferably of a diameter of somewhere between one inch to four inches, preferably two inches, especially when the outer sphere is approximately of 16 inches diameter.

The present toy ball can be made in diverse manners, however, generally the outer ball is merely vulcanized around the inner ball in techniques well known in the rubber manufacturing industry.

In light of the above details of its structure, it can be appreciated that the present toy ball achieves the unexpected advantages and features of the present invention by virtue of the fact that the erratic and unpredictable behavior of the outer ball 11 is greatly accentuated due to the high resiliency and coefficient of friction of the inner resilient ball member. Thus, the particular combination of these types of resilient materials produces a toy ball which presents a greater challenge to the user than such heretofore manufactured crazy or trick balls whereby a more entertaining and amusing toy is realized.

It will be apparent to one skilled in the art that various changes and modifications can be made in the above toy ball, as well as in its mode of manufacture, without departing from the true scope and spirit of the present invention and accordingly, it is to be understood that there is no indication to limit the invention necessarily to this specific form disclosed as long as the basic design criteria as set forth herein is followed. On the contrary, it is my intention to cover all modifications, alternative constructions, equivalents and uses falling within the spirit and scope of my invention which is expressed in the appended claims.

What I claim as invention is:

1. A toy ball susceptible to erratic and unpredictable movement in flight consisting of a first, outer smooth-surfaced spherical, outer ball member devoid of projections such as tethers, and made of a resilient material, said outer ball having a hollow interior and an outer wall having a thickness of between 1 to 3 percent of the diameter of said outer ball member; and a second, inner ball member positioned in free-moving relationship within said outer ball member, said inner ball member being solid and being made of a material that is significantly more resilient and having a higher coefficient of friction that that of said outer ball wherein said outer ball member has a diameter between 8 to 24 inches and said inner ball has a diameter between 1 to 4 inches.

2. The toy ball of claim 1 further characterized in that said second inner ball member is a highly resilient polybutadiene material.

3. The toy ball of claim 1 further characterized in that said inner ball member is a highly resilient masticated vulcanized cis-1,4 polyisoprene material.

4. The toy ball of claim 3 further characterized in that said first outer ball member is made of a natural rubber.

5. The toy ball of claim 4 further characterized in that said first outer ball member is 16 inches in diameter.

6. The toy ball of claim 5 further characterized in that said second inner ball member is two inches in diameter.

* * * * *